US007299721B1

(12) United States Patent
Eggert et al.

(10) Patent No.: US 7,299,721 B1
(45) Date of Patent: Nov. 27, 2007

(54) SOCKET INCLUDING A REINFORCING STRUCTURE

(75) Inventors: Daniel M. Eggert, Kenosha, WI (US); Marco E. DeVecchis, Racine, WI (US)

(73) Assignee: Snap-on INcororated, Kenosha, WI (US)

( * ) Notice: Subject to any disclaimer, the term of this patent is extended or adjusted under 35 U.S.C. 154(b) by 0 days.

(21) Appl. No.: 11/491,574

(22) Filed: Jul. 24, 2006

(51) Int. Cl.
*B25B 13/48* (2006.01)
*B25B 13/02* (2006.01)
*B25B 13/06* (2006.01)

(52) U.S. Cl. ..... 81/124.2; 81/121.1

(58) Field of Classification Search ..... 81/124.2, 81/119, 121.1, 125
See application file for complete search history.

(56) References Cited

U.S. PATENT DOCUMENTS 1,761,988 A * 6/1930 Layhon ..... 81/92
1,972,239 A * 9/1934 Rose ..... 81/58.1
2,503,364 A 4/1950 Viets
D160,267 S 9/1950 McCammon et al.
3,086,414 A 4/1963 Nardi
4,096,621 A 6/1978 Berger et al.
4,562,758 A * 1/1986 Stirling ..... 81/124.4
4,644,831 A * 2/1987 Yang ..... 81/125
4,765,009 A 8/1988 Hung
4,787,278 A * 11/1988 Bononi ..... 81/438
4,836,059 A 6/1989 Arnold
5,297,458 A 3/1994 Smith et al.
D355,343 S 2/1995 Gliddings, Jr.
5,425,290 A * 6/1995 Fought et al. ..... 81/44
D376,521 S 12/1996 Farnan et al.
5,724,872 A * 3/1998 Shih ..... 81/125
D398,493 S 9/1998 Jones
D403,934 S 1/1999 Girdler et al.
6,054,799 A 4/2000 Stefano
6,082,229 A * 7/2000 Shih ..... 81/125
6,178,854 B1 * 1/2001 Shih ..... 81/125
6,252,170 B1 6/2001 Korinek
6,378,401 B1 * 4/2002 Lordahl et al. ..... 81/124.4
6,923,096 B1 8/2005 Kim
6,938,522 B1 9/2005 Stannik
6,962,100 B2 * 11/2005 Hsien ..... 81/186
2005/0066780 A1 3/2005 Kobert et al.
2005/0178244 A1 8/2005 Hodges
2006/0090610 A1 * 5/2006 Liao ..... 81/121.1
2006/0117916 A1 * 6/2006 Hsieh ..... 81/124.4

* cited by examiner

*Primary Examiner*—David B Thomas
(74) *Attorney, Agent, or Firm*—Seyfarth Shaw LLP

(57) ABSTRACT

A socket for engaging a work piece having at least one wire. The socket includes a body having a closed peripheral side wall, first and second ends and a rotational axis extending between the first and second ends. The socket also includes a first receptacle formed in the first end and defining a drive structure configured for receiving a work piece for driving engagement therewith. A channel is formed in the side wall and opens at and extends laterally from the first end of the body for receiving the at least one wire.

22 Claims, 4 Drawing Sheets

SOCKET INCLUDING A REINFORCING STRUCTURE

BACKGROUND

A variety of wrenches are commonly used to apply torque to a work piece, such as a threaded fastener. The work pieces may have any number of different sizes and shapes. Accordingly, many wrenching tools include a driver which is mateable with any of a number of different adapters, such as sockets, to engage and rotate the different sized work pieces.

Sockets are interchangeable adapters which have an open end for engaging a work piece and an opposing end which engages a drive end of a driver device, such as a ratchet, breaker bar or the like. The open end of the socket defines a shape which corresponds to the shape of the work piece. Sockets are used to engage and rotate several different types of devices or parts. Some of these devices or parts include wires which must be connected to another device. Conventional sockets, such as those used to rotate bolts, do not have openings or other structures which enable wired devices to be inserted into the socket without damaging the wires. Thus, it is known to provide slotted sockets which include lateral openings on the body of the socket that enable the wires to be threaded out of a peripheral wall of the socket to prevent damage to the wires. However, such openings decrease the structural integrity and strength of the socket and thereby decrease the operative life of the socket.

Accordingly, there is a need for a socket which can rotate a work piece having a wire that does not cause damage to the wire and also which maintains the structural integrity and strength of the socket.

SUMMARY

The application is directed to a socket for a wrench and more specifically, to a socket having a channel that enables a device having a wire to be secured in the socket and the wire threaded through the channel without decreasing the structural integrity and strength of the socket.

One embodiment provides a socket for engaging a work piece having at least one wire. The socket includes a body having a closed peripheral side wall, first and second ends and a rotational axis extending between the first and second ends. The socket also includes a first receptacle formed in the first end. The first receptacle defines a drive structure configured for receiving a work piece for driving engagement therewith, and a channel formed in the side wall and opening at and extending laterally from the first end of the body for receiving the at least one wire.

In an embodiment, the socket includes a projection extending laterally from the side wall and defining the channel.

In an embodiment, the channel has a semi-circular cross-sectional shape.

In an embodiment, the channel has an axial extent and a lateral depth which varies along its axial extent.

In an embodiment, the drive structure includes an inner surface which is engageable with the work piece.

In an embodiment, the inner surface defines a plurality of engagement surface segments which frictionally engage the work piece.

In an embodiment, the inner surface defines a plurality of engagement surface segments which frictionally engage the work piece. The surface segments extend from the first end to a designated point from the first end, where the channel extends from the first end to at least the designated point.

In an embodiment, the body includes a second receptacle at the second end.

In an embodiment, the first receptacle defines an inner end wall, and further includes at least one reinforcing rib positioned in the first receptacle. The rib includes a first end and a second end. The first end is connected to the side wall and the second end is connected to the inner end wall.

Another embodiment provides a socket for engaging a work piece. The socket includes a body having a closed peripheral side wall and first and second ends. A first receptacle is formed in the first end for receiving at least a portion of the work piece, and a second receptacle is formed in the second end for receiving a driving device. The socket includes a projection extending laterally from the side wall and defining a channel communicating with the first receptacle and opening at the first end.

In an embodiment, the projection is integrally formed with the side wall.

In an embodiment, at least a portion of the side wall includes an inner surface for engaging the work piece.

In an embodiment, the inner surface defines a plurality of engagement surface segments for engaging the work piece.

In an embodiment, the inner surface defines a plurality of engagement surface segments which frictionally engage the work piece. The surface segments extend from the first end to a designated point from the first end. The channel extends from the first end to at least the designated point.

In an embodiment, the second receptacle includes at least one recess. The recess is engageable with a driving device to temporarily secure the driving device in the second receptacle.

In an embodiment, the body includes an inner end wall separating the first and second receptacles.

In an embodiment, the socket includes at least one reinforcing rib positioned in the first receptacle. The rib includes a first end and a second end. The first end is connected to the side wall and the second end is connected to the inner end wall.

Accordingly, an advantage is to provide a socket that defines a channel to enable a wire of a device inserted in the socket to extend from the socket.

Another advantage is to provide a socket having a projection that defines a channel which enhances the structural integrity and strength of the socket.

A further advantage is to provide a socket including a projection which enables a user to easily grip and manually rotate the socket.

Other objects, features and advantages will be apparent from the following detailed disclosure, taken in conjunction with the accompanying sheets of drawings, wherein like numerals refer to like parts, elements, components, steps and processes.

DETAILED DESCRIPTION

Figure 1:
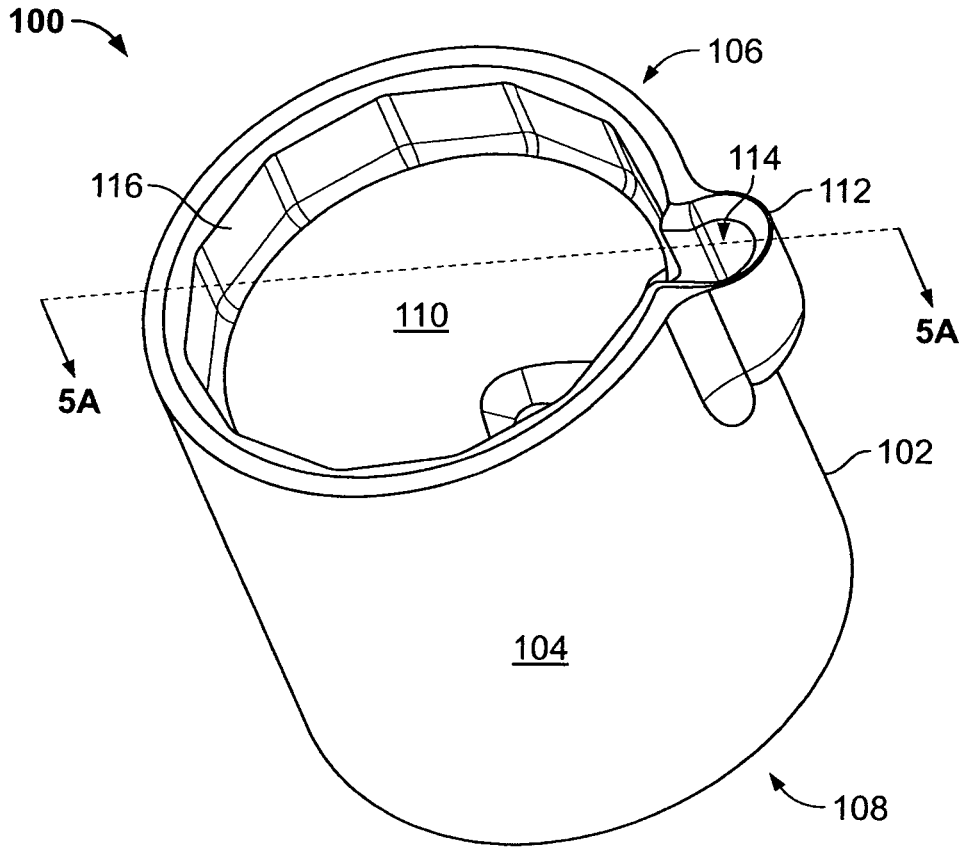
FIG. 1 is a perspective view of an embodiment of the socket.
Figure 2:
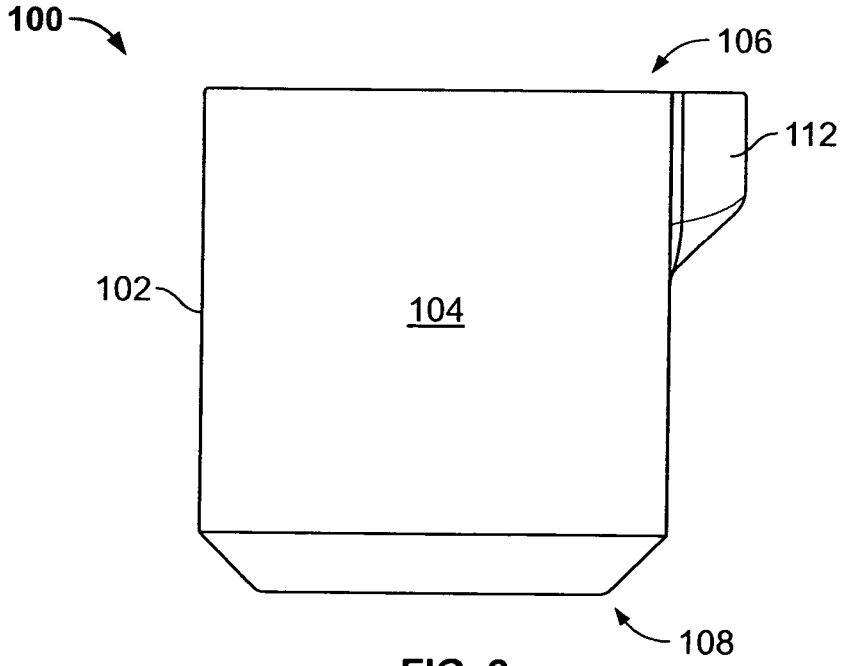
FIG. 2 is a side view of the socket shown in FIG. 1.
Figure 3:
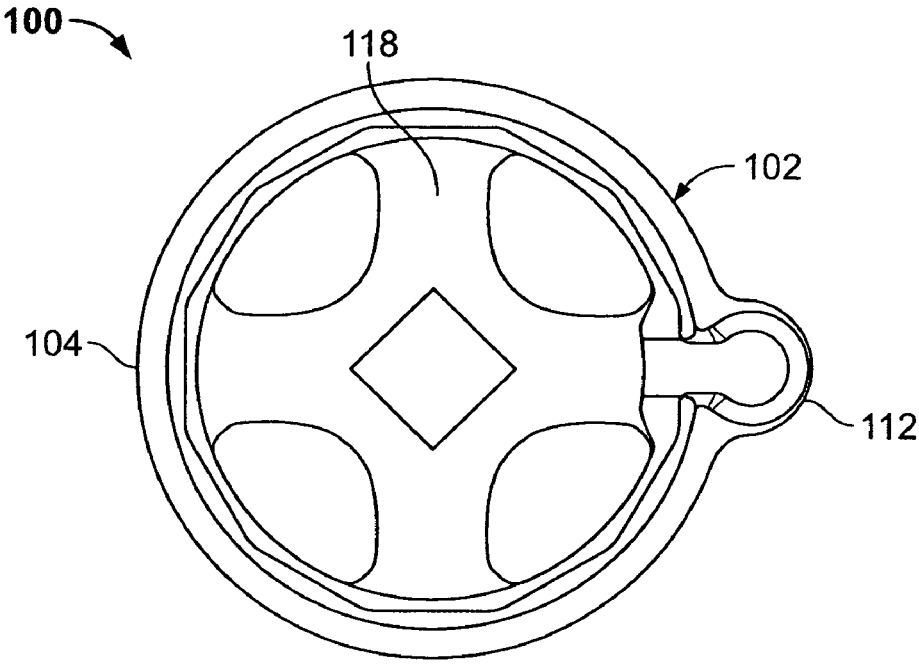
FIG. 3 is an end view of a first end of the socket shown in FIG. 1.
Figure 4:
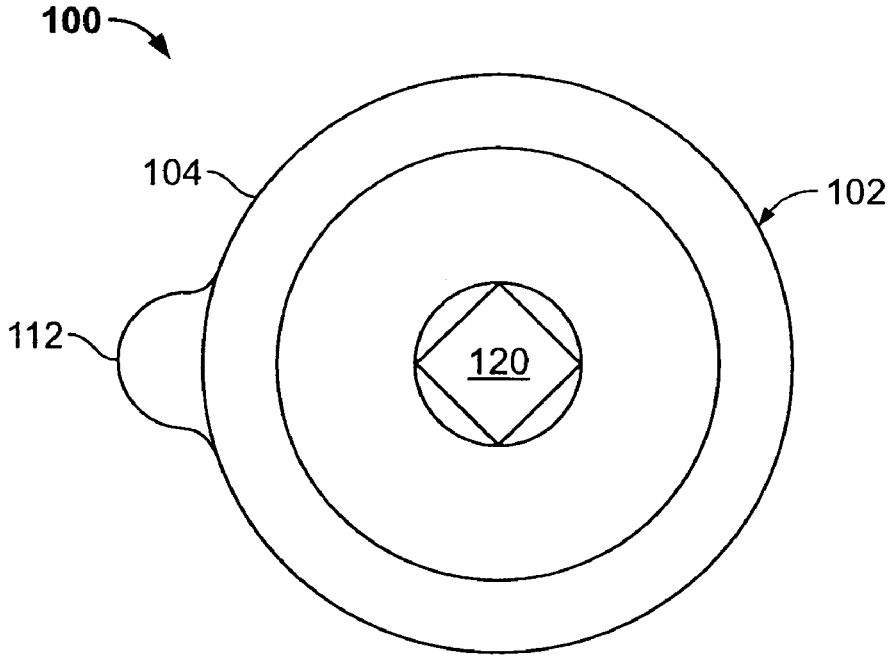
FIG. 4 is an end view of a second end of the socket shown in FIG. 1.

Referring now to FIGS. 1, 2, 3, 4, 5A and 5B, in one embodiment, a socket 100 for a wrenching device, such as a ratchet wrench, is provided where the socket includes a generally cylindrical body 102. The body 102 has an outer surface which may be cylindrical or any other suitable size or shape. In the illustrated embodiment, the body 102 has a closed, peripheral side wall 104, a first end 106 and a second end 108. Formed in the first end 106 is an interior space or receptacle 110. The receptacle 110 is formed or configured to a engage a work piece, such as an electronic sensor 150, having one or more wires 155.

The receptacle 110 defines a plurality of flat engagement surface segments or facets 116. The plurality of facets 116 form a substantially dodecagonal, hexagonal or similar shape corresponding to the outside surface and shape of a work piece, such as the electronic sensor 150, described above. It should be appreciated that the facets 116 may have any suitable shape.

In an embodiment, a boss or projection 112 is integrally formed with the body 102. For example, in the illustrated embodiment, the projection 112 is integrally formed with the side wall 104 of the body. The projection 112 has a hollow interior which defines an open-ended channel 114. The open-ended channel 114 generally extends from end 106 of the body to the interior space or receptacle 110. It should be appreciated that the projection 112 may be formed on any part of the body 102. For example, the projection 112 may extend to a designated point from the end 106 of the body or extend the entire length of the side wall 104. In the illustrated embodiment, the projection 112 includes a generally rounded configuration and the channel 114 is generally part-circular in transverse cross-section. It should be appreciated that the projection 112 may have any suitable size or shape.

Figure 5A:
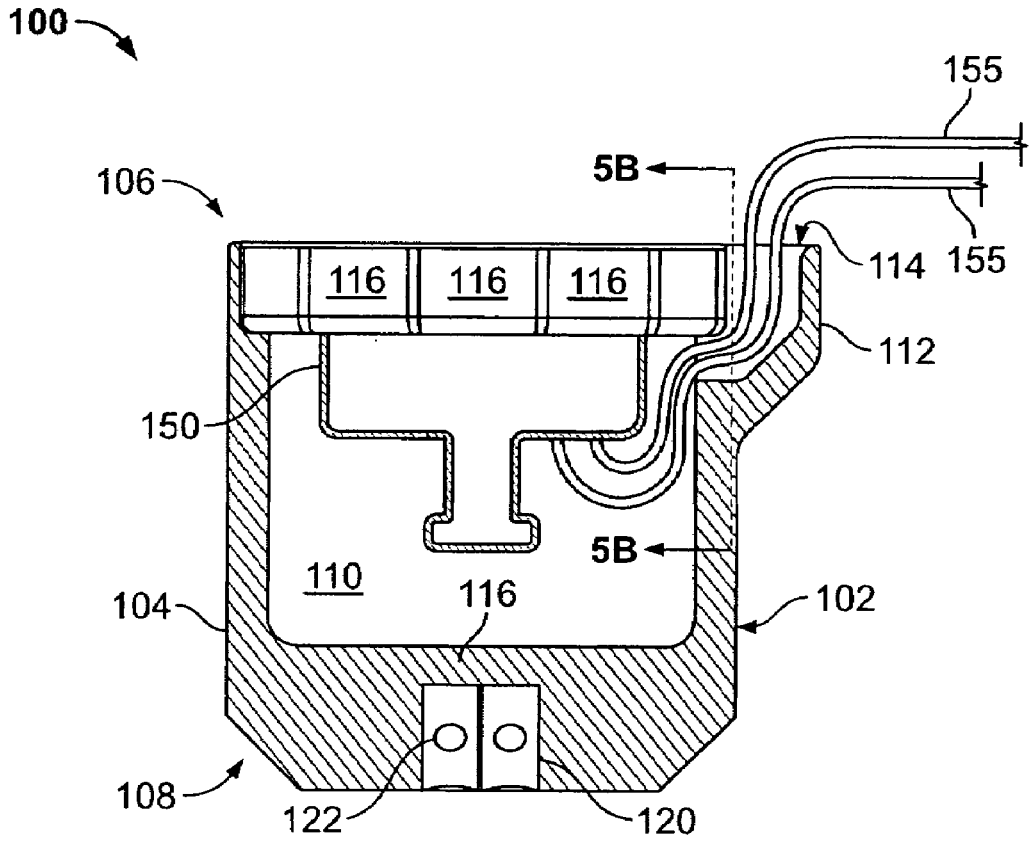
FIG. 5A is a cross-section view taken substantially along line 5A-5A of FIG. 1.
Figure 5B:
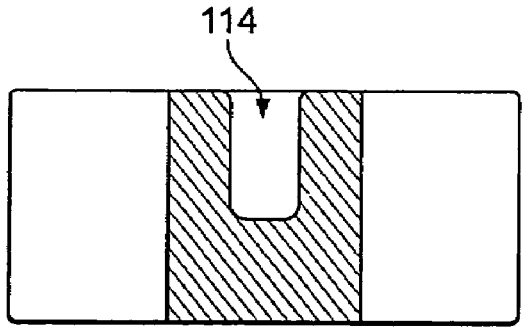
FIG. 5B is a cross-section view taken substantially along line 5B-5B of FIG. 5A where a sensor including wires is positioned in the socket.

As shown in FIGS. 5A and 5B, a wire or wires 155 connected to a work piece 150 may be positioned in or threaded through the open-ended channel 114 to enable the wires to extend from the socket when the work piece is disposed in the receptacle 110.

In the illustrated embodiment, the inner end of the receptacle 110 is closed by an inner end wall 116. At least one reinforcing rib or arm 118 is integrally formed with inner end wall 116 in the receptacle 110. In an embodiment, the inner end wall 116 includes four reinforcing ribs 118. The reinforcing ribs or arms 118 increase the structural integrity and strength of the socket and thereby prolong the operative life of the socket. It should be appreciated that one or more reinforcing ribs may be integrally formed with or connected to the body 102 of the socket.

The second end 108 defines a drive receptacle 120 which has a generally square shape for receiving a drive end of a device, such as a ratchet, and which is separated from the receptacle 110 by the inner end wall 116. The drive receptacle 120 may have any suitable size or shape corresponding to the drive end of a drive device such as a ratchet. In the illustrated embodiment, the drive receptacle 120 defines one or more detent recesses 122. The recesses 122 are engaged by detent members, such as balls, connected to the drive end of a tool (not shown). The detent members on the drive end of the tool are biased outwardly to seat in the corresponding recesses 122 of the drive receptacle 120 in a known manner. Engagement between the recesses 122 and the detent members of the drive end of the tool temporarily secure the drive end of the tool in the drive receptacle 120. The detent members are releasable from the recesses 122 by pulling the drive end out of the drive receptacle 120 using a predetermined force. It should be appreciated that the drive receptacle 120 may include recesses or any suitable engagement members to secure the drive end to the drive receptacle.

Figure 6:
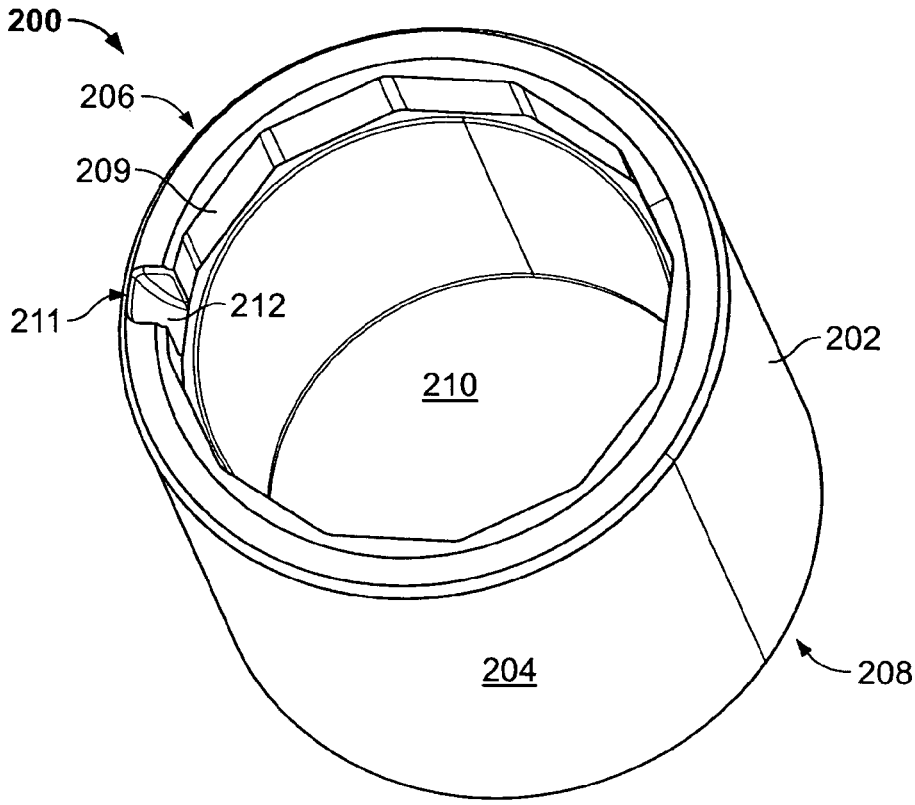
FIG. 6 is a perspective view of another embodiment of the socket.

Referring now to FIG. 6, another embodiment provides a socket 200 including a body 202 having a closed, peripheral side wall 204, a first end 206 and a second end 208. A receptacle 210 is formed in the first end 206 and defines one or more engagement surfaces or facets 209 for frictionally engaging a work piece to be driven by the socket. In this embodiment, the side wall 204 of the body 202 has a designated thickness or width. The thicker side wall 204 increases the structural integrity and strength of the socket and reduces the likelihood of mechanical failure during use. Furthermore, a groove or open-ended channel 211 is defined by the side wall 204 to enable one or more wires of a work piece to be positioned in or threaded through the channel. The channel 211 in the illustrated embodiment includes at least one inclined or sloped wall 212. It should be appreciated that the channel 211 may have any suitable shape or be of any suitable size.

Figure 7:
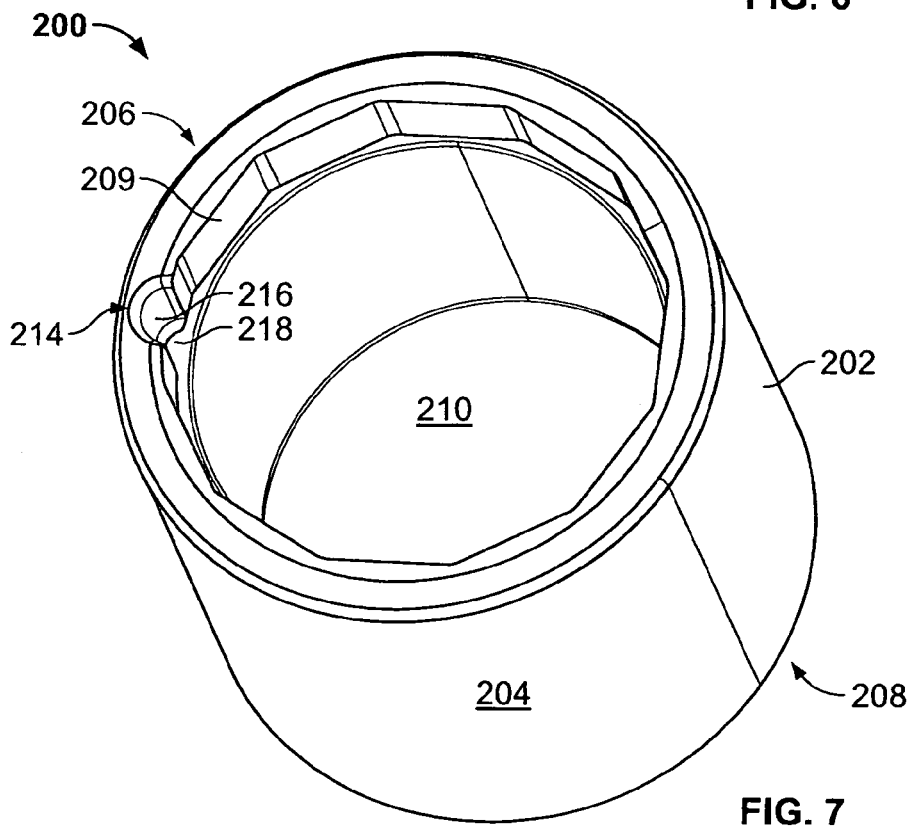
FIG. 7 is a perspective view of a further embodiment of the socket.

Referring now to FIG. 7, another embodiment provides a socket similar to the socket of FIG. 6 where the side wall 204 defines a groove or channel 214. In this embodiment, the groove or channel 214 includes a semi-circular wall 216. Furthermore, the bottom end of the channel or groove is substantially closed by lip 218. Therefore, one or more wires associated with a device engaged with the socket are threaded over the lip 218, up through the channel 214 and out of the socket 200.

In the above embodiments, the socket 200 may include one or more projections and/or one or more channels for threading wires or similar cables from an interior part of the socket to a point or distance away from the socket. Additionally, the sockets described in the above embodiments are made of a suitable durable material such as stainless steel. It should be appreciated that the socket and/or any portions of the socket may be made of any suitable material or materials.

The embodiments set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A socket for engaging a work piece having at least one wire, the socket comprising:

a body having a closed peripheral side wall, first and second ends and a rotational axis extending between the first and second ends; and a first receptacle formed in the first end and defining a drive structure configured for receiving a work piece for driving engagement therewith, and a channel formed in the side wall and opening at and extending laterally from the first end of the body for receiving the at least one wire, the channel having an axial extent and a lateral depth which varies along its axial extent.

2. The socket of claim 1, wherein the channel has a semi-circular cross-sectional shape.

3. The socket of claim 1, wherein the drive structure includes an inner surface which is engageable with the work piece.

4. The socket of claim 3, wherein the inner surface defines a plurality of engagement surface segments which frictionally engage the work piece.

5. The socket of claim 3, wherein the inner surface defines a plurality of engagement surface segments which frictionally engage the work piece, the surface segments extending from the first end to a designated point from the first end, wherein the channel extends from the first end to at least said designated point.

6. The socket of claim 1, wherein the body includes a second receptacle at the second end.

7. The socket of claim 1, wherein the first receptacle defines an inner end wall, and further includes at least one reinforcing rib positioned in the first receptacle, the rib including a first end and a second end, the first end connected to the side wall and the second end connected to the inner end wall.

8. A socket for engaging a work piece having at least one wire, the socket comprising;

a body having a closed peripheral side wall, first and second ends and a rotational axis extending between the first and second ends; and a first receptacle formed in the first end and defining a drive structure configured for receiving work piece for driving engagement therewith, and a channel formed in the side wall and opening at and extending laterally from the first end of the body for receiving the at least one wire, which includes a projection extending laterally from the side wall defining the channel.

9. A socket for engaging a work piece, the socket comprising:

a body having a closed peripheral side wall and first and second ends, a first receptacle formed in the first end for receiving at least a portion of the work piece, and a second receptacle formed in the second end for receiving a driving device; and a projection extending laterally from the side wall and defining a channel communicating with the first receptacle and opening at the first end.

10. The socket of claim 9, wherein the projection is integrally formed with the side wall.

11. The socket of claim 9, wherein at least a portion of the side wall includes an inner surface for engaging the work piece.

12. The socket of claim 11, wherein the inner surface defines a plurality of engagement surface segments for engaging the work piece.

13. The socket of claim 11, wherein the inner surface defines a plurality of engagement surface segments which frictionally engage the work piece, the surface segments extending from the first end to a designated point from the first end, wherein the channel extends from the first end to at least said designated point.

14. The socket of claim 9, wherein the second receptacle includes at least one recess, the recess being engageable with a driving device to temporarily secure the driving device in the second receptacle.

15. The socket of claim 9, wherein the body includes an inner end wall separating the first and second receptacles.

16. The socket of claim 15, which includes at least one reinforcing rib positioned in the first receptacle, the rib including a first end and a second end, the first end connected to the side wall and the second end connected to the inner end wall.

17. A socket for engaging a work piece having at least one wire, the socket comprising:

a body having a closed peripheral side wall, first aid second ends and a rotational axis extending between the first and second ends; and a first receptacle formed in the first end and defining a drive structure configured for receiving a work piece for driving engagement therewith, and a channel formed in the side wall and opening at and extending laterally from the first end of the body for receiving the at least one wire, the first receptacle further defining an inner end wall, and further including at least one reinforcing rib positioned in the first receptacle, the rib including a first end and a second end, the first end connected to the side wall and the second end connected to the inner end wall.

18. The socket of claim 17, wherein the channel has a semi-circular cross-sectional shape.

19. The socket of claim 17, wherein the drive structure includes an inner surface which is engageable with the work piece.

20. The socket of claim 19, wherein the inner surface defines a plurality of engagement surface segments which frictionally engage the work piece.

21. The socket of claim 19, wherein the inner surface defines a plurality of engagement surface segments which frictionally engage the work piece, the surface segments extending from the first end to a designated point from the first end, wherein the channel extends from the first end to at least said designated point.

22. The socket of claim 17, wherein the body includes a second receptacle at the second end.

* * * * *

UNITED STATES PATENT AND TRADEMARK OFFICE

CERTIFICATE OF CORRECTION

PATENT NO. : 7,299,721 B1 
APPLICATION NO. : 11/491574
DATED : November 27, 2007
INVENTOR(S) : Daniel M. Eggert and Marco E. Devecchis It is certified that error appears in the above-identified patent and that said Letters Patent is hereby corrected as shown below:

On the Title Page, Item [73] Assignee

"Snap-on INcororated, Kenosha, WI (US)" should be corrected as --Snap-on Incorporated, Kenosha, WI (US)--

Column 6

Claim 17; line 20 "aid" should be --and--.

Signed and Sealed this

Twenty Second Day of April, 2008

JON W. DUDAS
*Director of the United States Patent and Trademark Office*